US006755052B1

(12) United States Patent
Sytz

(10) Patent No.: US 6,755,052 B1
(45) Date of Patent: Jun. 29, 2004

(54) KNITTED STRETCH SPACER MATERIAL AND METHOD OF MAKING

(76) Inventor: Ronald M. Sytz, 3416 Country Club Dr., Gastonia, NC (US) 28056

( * ) Notice: Subject to any disclaimer, the term of this patent is extended or adjusted under 35 U.S.C. 154(b) by 0 days.

(21) Appl. No.: 10/345,628

(22) Filed: Jan. 16, 2003

(51) Int. Cl.[7] ..... D04B 9/06
(52) U.S. Cl. ..... 66/196; 66/19
(58) Field of Search ..... 66/195, 196, 202, 66/88, 87, 19, 193; 442/309, 310, 317, 313

(56) References Cited

U.S. PATENT DOCUMENTS 4,785,558 A * 11/1988 Shiomura ..... 36/114
4,787,219 A * 11/1988 Sato et al. ..... 66/190
5,385,036 A * 1/1995 Spillane et al. ..... 66/87
5,413,837 A * 5/1995 Rock et al. ..... 428/192
5,651,847 A * 7/1997 Loeffler ..... 66/19
5,896,758 A * 4/1999 Rock et al. ..... 66/191
6,105,401 A * 8/2000 Chadeyron et al. ..... 66/195
6,116,059 A * 9/2000 Rock et al. ..... 66/191
6,196,032 B1 * 3/2001 Rock et al. ..... 66/195
6,199,410 B1 * 3/2001 Rock et al. ..... 66/195
6,263,707 B1 7/2001 Miller et al.

* cited by examiner

*Primary Examiner*—Danny Worrell
(74) *Attorney, Agent, or Firm*—Glasgow Law Firm, PLLC

(57) ABSTRACT

A knitted spacer material including the use of a stretch yarn component for stretch, compression resistance, decreased weight, and improved drape and/or conformability.

18 Claims, 4 Drawing Sheets

KNITTED STRETCH SPACER MATERIAL AND METHOD OF MAKING

BACKGROUND OF THE INVENTION (1) Field of the Invention

The present invention relates generally to textile products and, more particularly, to a knitted spacer material including the use of spandex for providing improved stretch, compression resistance, decreased weight, and conformability and/or drape.

(2) Description of the Prior Art

U.S. Pat. No. 5,413,837 issued May 9, 1995 to Rock, et al. for Three-dimensional knit fabric teaches a three-dimensional knit or woven fabric that is permeable to water vapor but impermeable to liquid water is provided, including a first fabric layer, a second fabric layer and yarn interconnecting them, further including a barrier layer adhered to the outside surfaces, and the fabric being imperviously sealed.

U.S. Pat. No. 5,651,847 issued Jul. 29, 1997 to Loeffler for Double-face circular knit teaches a double face circular knit having two concentric lengths of knit web and an in-between spacer structure, wherein spacer threads are textured coarse-filament multifilament yarns, in combination with monofilament yarns.

U.S. Pat. No. 6,263,707 issued Jul. 24, 2001 to Miller, et al. for Opaque heat-moldable circular knit support fabrics having very high spandex content teaches a fabric and method including opaque heat-moldable circular knit fabrics having relatively high amounts of spandex material and other fibers to simultaneously provide maximum support and comfort to a wearer, wherein the fabric may be molded to the specifications of a wearer's body.

Prior art knitted spacer material commonly employs either warp-knitting or circular knitting techniques to produce a fabric having a predetermined thickness and bulk. However, the prior art knitted spacer materials typically have a relatively high weight, low stretch, and limited drape, since the fabric thickness and compressibility are factors that are generally optimized for a given application.

Thus, there remains a need for a knitted spacer material having increased stretch and compression resistance, decreased weight, and improved drape.

SUMMARY OF THE INVENTION

The present invention is directed to a knitted stretch spacer material including the use of SPANDEX for stretch and compression resistance without increasing weight, and improved comformability and/or drape. The present invention is further directed to a knitted spacer material further processed for particular applications, for example including lamination and/or coating to provide a liquid and vapor impermeable fabric, in particular for diving and wet suit applications. The present invention is still further directed to a method for making a knitted spacer material having high stretch, compression resistance, low weight, and improved drape or conformability.

Accordingly, one aspect of the present invention is to provide a knitted spacer material including a fabric having a face surface and a back surface in spaced apart relation with a body portion constructed therebetween, wherein the fabric further includes a stretch yarn component for increased stretch and compression resistance of the material.

Another aspect of the present invention is to provide a knitted spacer material that functions as a carrier or a substrate, further including a secondary component, which may be applied as a coating, a lamination, and/or an infusion.

Still another aspect of the present invention is to provide a method for producing a knitted spacer material, in particular a circular knitted spacer material.

These and other aspects of the present invention will become apparent to those skilled in the art after a reading of the following description of the preferred embodiment when considered with the drawings.

DETAILED DESCRIPTION OF THE PREFERRED EMBODIMENTS

Figure 1:
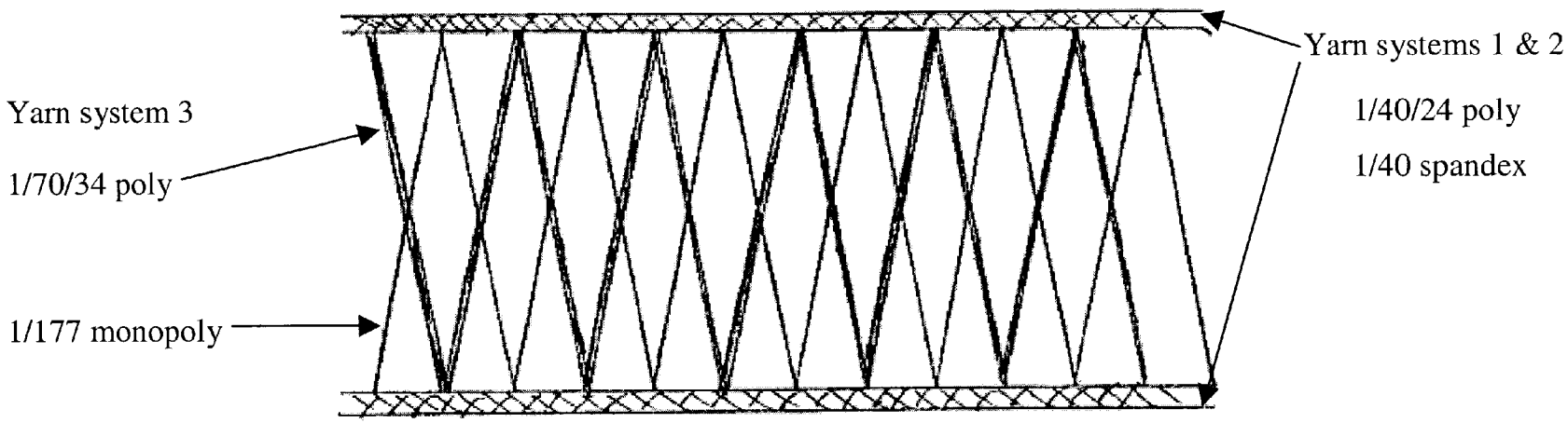
FIG. 1 is a side cross-sectional view of a spacer material constructed according to the present invention.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

Figure 2:
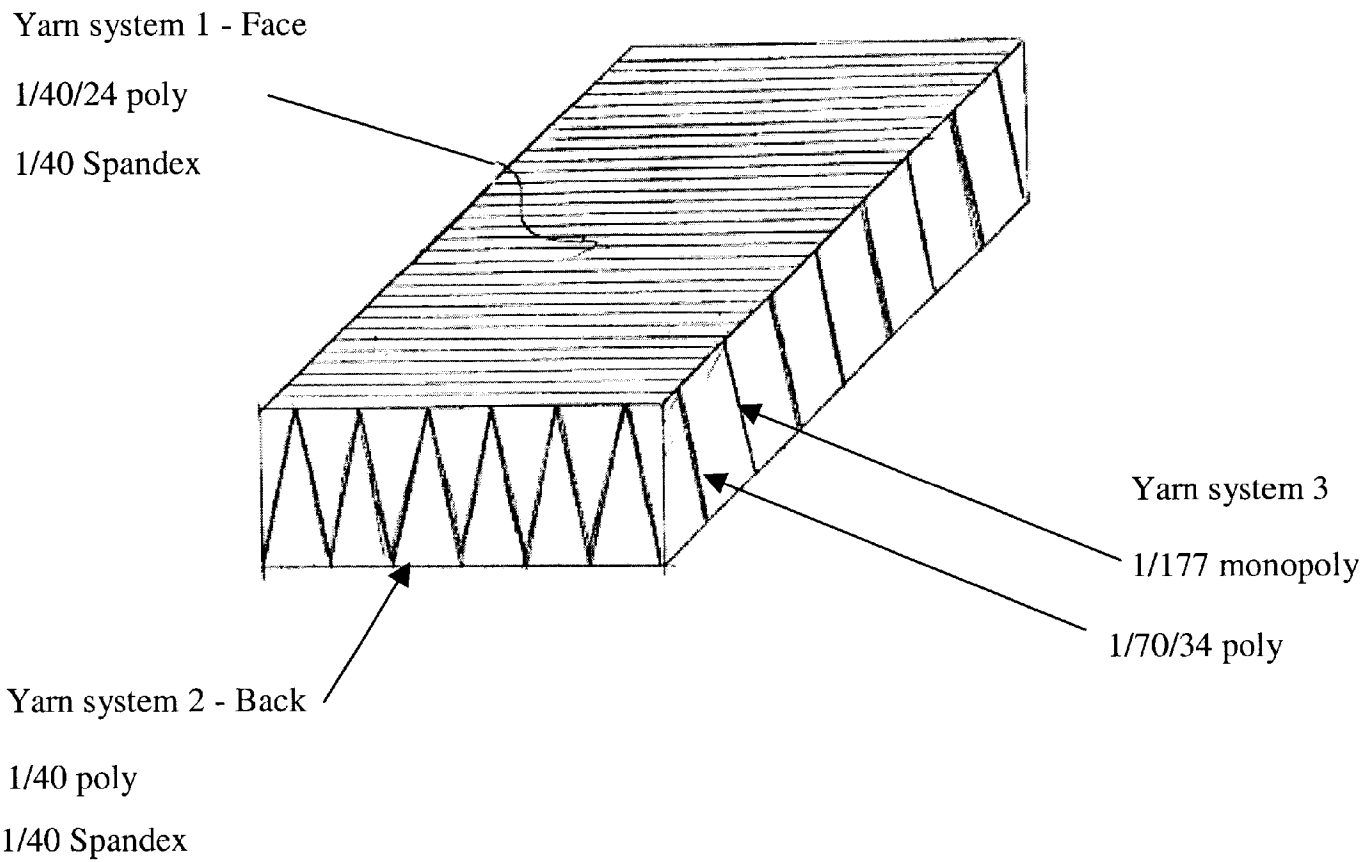
FIG. 2 is a perspective view of an embodiment of the present invention.

Referring now to the drawings in general, the illustrations are for the purpose of describing a preferred embodiment of the invention and are not intended to limit the invention thereto. As best seen in FIG. 1, a knitted spacer material, generally referenced 10, is illustrated. The spacer material is preferably a 3-dimensional material, having an x-direction and y-direction forming a fabric plane and a z-direction that is orthogonal to the other directions, as shown in FIG. 2, i.e., forming a thickness (t) out of the fabric plane. includes at least two yarn systems, including a first yarn system and a second yarn system that are interlaced with a third yarn system to form a knitted material. FIG. 1 illustrates an embodiment according to the present invention having three yarn systems, a first yarn system 12, a second yarn system 14, and a third yarn system 16 formed of both monofilament and a multifilament or other yarn(s); the first and second yarn systems preferably include a SPANDEX or stretch yarn component. More specifically, the knitted material has a face surface 18 (also shown in FIG. 2) and a back surface 20 with a body portion 22 of the material formed therebetween having a thickness measured between the two surfaces. The body portion includes the third yarn system providing a compression resistant component substantially oriented in the z-direction or thickness direction of the material; while this component does extend in the x-direction and y-direction of the material as well, its main function is to provide the material properties in the z-direction or thickness by traversing between the face and back surfaces of the material, forming a zig-zag appearance when viewed from a side view as shown in FIG. 1. Importantly, according to a preferred embodiment of the present invention, at least this first yarn system includes a SPANDEX or a stretch component for increased stretch of the material in both the x- and y-directions; preferably, the first and second yarn systems in an embodiment as shown in FIGS. 1 and 2, include a SPANDEX or stretch yarn component. Surprisingly, the inclusion of the SPANDEX or stretch component introduces a substantially increased compression resistance in the material in the z-direction or thickness dimension. The SPANDEX, elastomeric synthetic material, or stretch component of the fabric preferably provides for an increased stretch between about 25%×25% in the x- and y-directions, respectively, to about 150%×200% in the x- and y-directions, respectively, more preferably about 100%×120% in the x- and y-directions, respectively. Surprisingly and significantly, it is important to recognize that this inclusion of SPANDEX or stretch yarn component in the first and second yarn systems has allowed the reduction of yarn size, including weight and stiffness, in the third yarn system which has allowed the material according to the present invention to perform to the desired objectives, as set forth in the foregoing, namely, to provide a knitted stretch spacer material including the use of SPANDEX or a stretch yarn component in predetermined levels to provide for stretch and compression resistance, without increasing weight, and improved drape and/or comformability that is further processed, including lamination and/or coating, to provide a liquid and vapor impermeable fabric, in particular for diving and wet suit applications. The conformability is qualitatively measured as the fabric's ability to change direction and shape to conform to a user's body, in particular when the fabric is incorporated into a garment or a portion of a garment or other bodily coverage. The knitted spacer material according to the present invention is formed with a face surface and a back surface in spaced apart relation with a body portion constructed therebetween, wherein the fabric further includes a stretch yarn component for increased stretch and compression resistance of the material, including after further processing, such as lamination and/or coating.

By way of specific design example, a knitted stretch spacer material that is further processed via lamination, specifically having lamination on one of either the face or back surface, wherein the knitted stretch spacer material is manufactured by Beverly Knits, Inc. under the sample number BK 3595 Heavy at 22 oz/sq.yd, or under the sample number BK 3571 Light—19 oz/sq yd, having a non-laminated weights of 21 oz/sq. yd and 16.7 oz/sq. yd, respectively. The lamination used is a commercially available Shawmut one-sided laminate at approximately 1–2 ounces. After lamination, the equivalent neoprene is about 32–42 ounces per square yard.

Furthermore, the material according to one embodiment of the present invention preferably has a thickness between about 2 mm to about 7 mm, more preferably between about 4 mm and about 6 mm. The drape is further characterized as being a conformability factor, i.e., the capacity of the material or fabric to adapt to curvature, more particularly, to change direction and shape to conform to a user's body, in particular when the fabric is incorporated into a garment or a portion of a garment or other bodily coverage.

Preferably, the knitted spacer material is formed of synthetic fibers in at least one of the yarn systems. Furthermore, in a preferred embodiment of the present invention, monofilament is used in at least one of the yarn systems, preferably in the third yarn system. Importantly, the monofilament component provides for additional improvement for compressibility and recovery as well as reducing the overall weight of the material. The compressibility and recovery properties of the present invention make it well-suited for impact dispersion applications.

By contrast, a prior art material manufactured from a warp-knit structure has significantly less stretch in the x- and y-directions than the present invention, as well as being thinner in the z-direction and being an overall heavier fabric per linear square unit. Note however, that some warp knitted materials may be manufactured at higher thicknesses, depending upon the specifications and/or desired characteristics of the fabric in a particular application, as is apparent to one of ordinary skill in the art.

FIG. 2 illustrates another side view of an alternative embodiment according to the present invention, having modified properties, in particular affecting the stretch and/or compression resistance and recovery of the material.

While preferably, the present invention is a circular knit material, a warp-knit material may also be produced according to the present invention as set forth hereinabove without departing from the scope and spirit of the invention.

Figure 3:
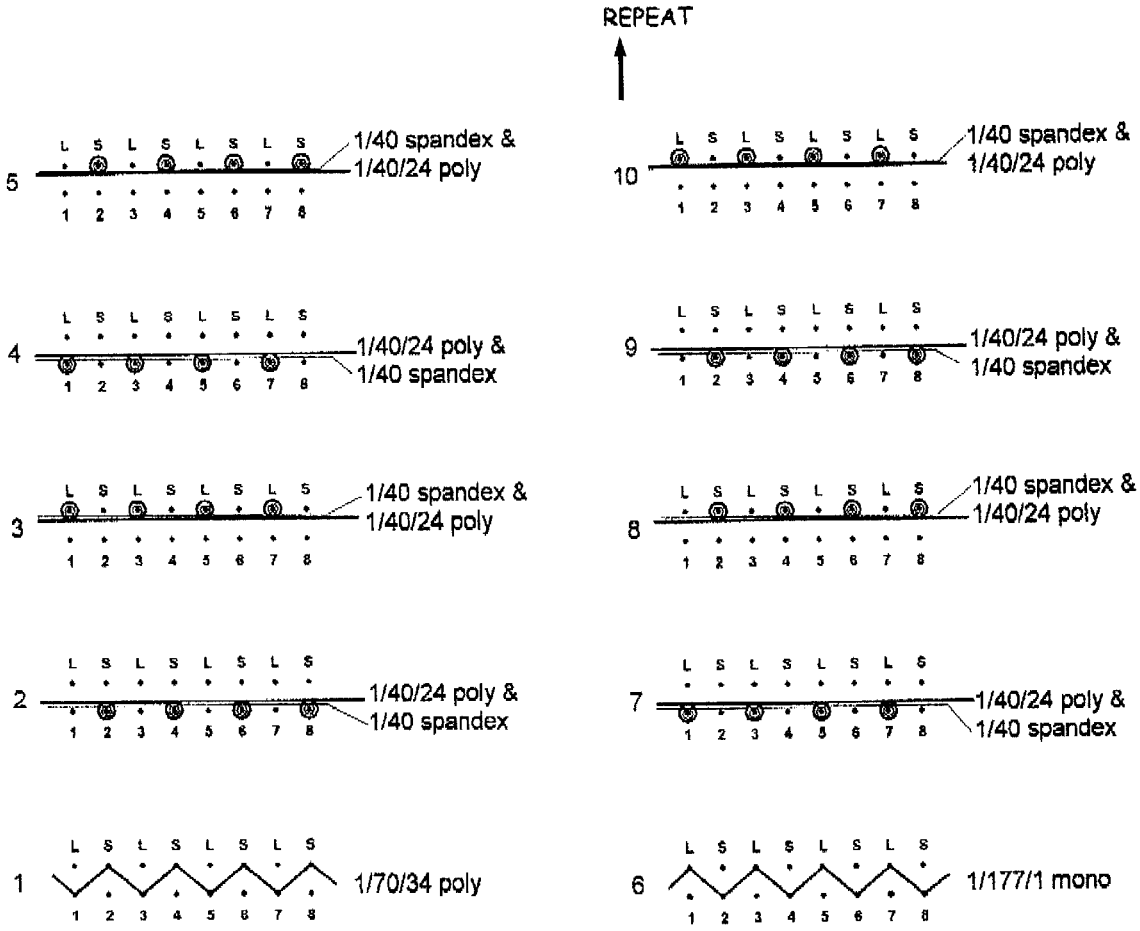
FIG. 3 is a knitting pattern for manufacturing an embodiment of a spacer material constructed according to the present invention.
Figure 4:
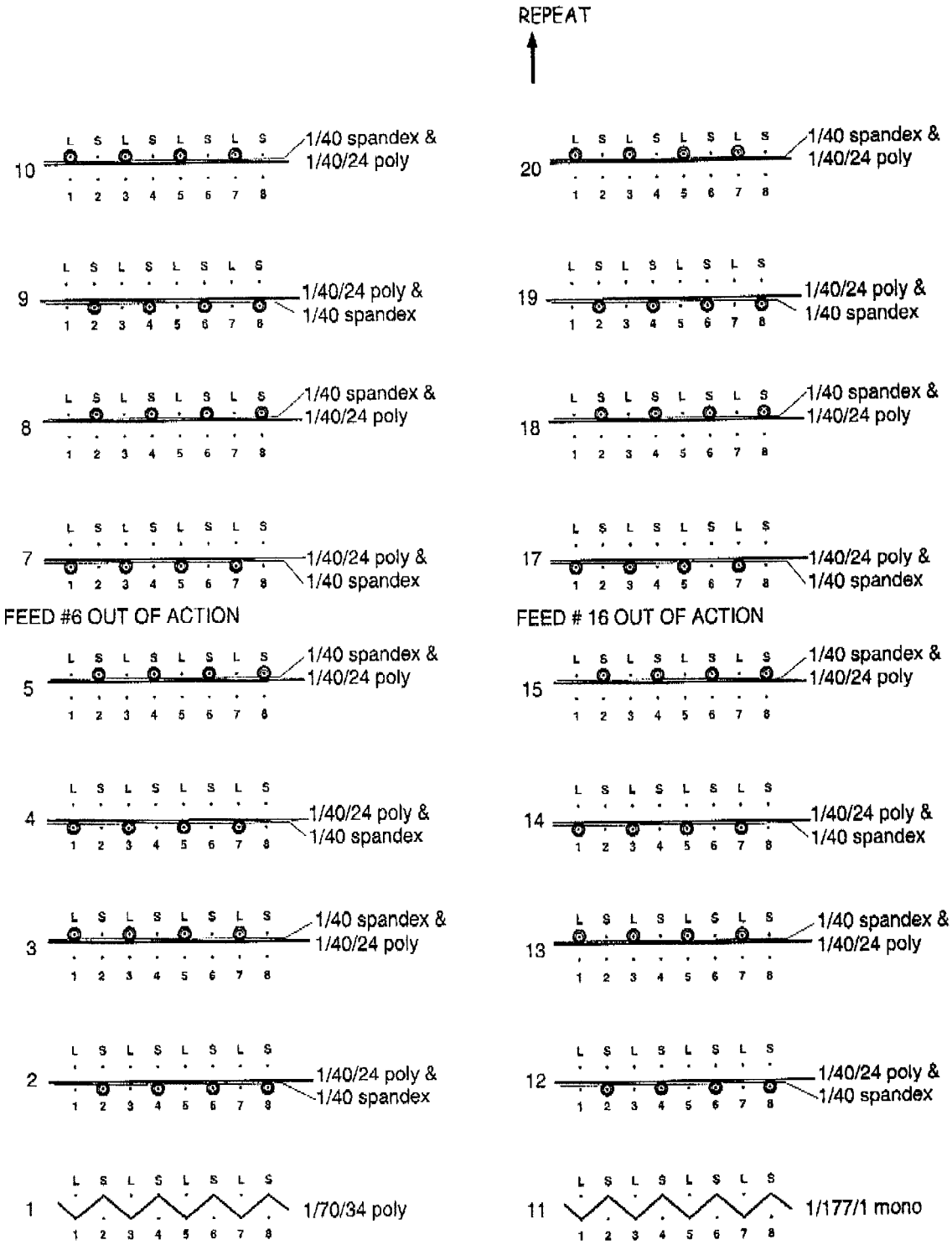
FIG. 4 is a knitting pattern for manufacturing another embodiment of a spacer material constructed according to the present invention.

FIGS. 3 and 4 show knitting pattern examples used in methods for manufacturing the knitted stretch spacer material according to the present invention. In particular, FIG. 3 shows a knitting pattern for a basic weft knit spacer material having a predetermined density and number of ends per centimeter. SPANDEX or stretch yarn component were added in this knitting design to at least one of the yarn systems for providing increased stretch and recovery properties in the finished material. Without making any modifications to the yarn densities and/or knitting, the overall material weight increased upon the addition of a stretch yarn component. Surprisingly, and after much experimentation, the knitting pattern shown in FIG. 4 was adapted to manufacture a knitted stretch spacer material according to the present invention wherein up to about a 50% reduction in monofilament yarns were required to be employed in the yarn system(s) of that embodiment, while providing a finished material having approximately equal or improved stretch and recovery, drape and/or conformability, and similar compression resistance to the embodiment shown in FIG. 3, while decreasing the overall material weight by comparison. The number of courses per inch and wales per inch of the knitted structure were higher and provided increased fabric density. Therefore, the present invention provides a method of manufacturing a knitted stretch spacer material by incorporating a stretch yarn component and reducing the monofilament component(s) by up to about 50%, while retaining compression resistance, and providing improved stretch and recovery, drape and/or conformability, and overall decreasing the material weight. A method of manufacturing a knitted spacer material including the steps of: providing at least two yarn systems for interconnecting via a knitting pattern, wherein at least one of the at least two yarn systems includes a stretch yarn component and at least one of the at least two yarn systems includes a monofilament component; knitting the stretch yarn component according to the pattern, which permits the elimination of up to about 50% of the monofilament weight of a standard, non-stretch spacer fabric without a stretch yarn component, while providing for comparable stretch and compression resistance, decreased weight, and increased conformability of the spacer material compared to the standard, non-stretch spacer fabric. Note that, while most knitted structures provide for some stretchability, non-stretch fabric, as used in the foregoing description refers to a knitted fabric having stretch limited substantially to that stretch provided by the knitting pattern itself, and not due significantly to the yarn components used in manufacturing the spacer material or fabric.

Certain modifications and improvements will occur to those skilled in the art upon a reading of the foregoing description. In particular, the knitted spacer material may function as a carrier or substrate, wherein additional processing provides additional and/or supplemental functionality not inherently present in the material itself. By way of example, the present invention may be further processed, e.g., by lamination or coating the fabric, to produce a laminated or coated knitted spacer material for application as a neoprene replacement, in particular for diving and/or wet suit applications. Additionally, the knitted spacer material may be infused with another substance, such as a medication, for use as a bandaging material capable of releasing a medication at the location of its application, e.g., directly to a wound. Certain coatings can be applied to this spacer fabric to achieve different benefits and/or fabric characteristics or properties. By way of example and not limitation, a phase change material may be applied to provide thermal management properties, antimicrobial coatings or yarns may be used to manage, control, or limit bacterial growth. Seaming, sealing, or other edge processing, e.g, overedge sealing, ultrasonic or RF welding, or seaming, may also be advantageously included in additional processing, depending upon the application for the material, in particular where it is used as a carrier material or substrate. All modifications and improvements have been deleted herein for the sake of conciseness and readability but are properly within the scope of the following claims.

DESIGN EXAMPLE(S)

This section outlines a few design examples, not necessarily optimized, but illustrative of what can be done for a knitted spacer material according to the present invention and method of manufacturing the same. These design examples include the following:

Example 1

In this preferred embodiment of the knitted spacer material as shown in FIG. 1 and having a knitting pattern shown in FIG. 3, the material was formed using the following components:

In the first yarn system direction, a Polyester yarn type of 40 denier was used in combination with a 40 denier spandex yarn; in the second yarn system, a Polyester yarn type of 40 denier was used in combination with a 40 denier spandex yarn; in the third yarn system, a Polyester yarn type of 177 denier monofilament was used in combination with a 70 denier polyester yarn. The machine set up included the following parameters: A double knit machine with a dial height variance up to 250 thousands separation from the cylinder, utilizing spandex feeder to plait spandex on the dial only and cylinder only feeds. Requirements include facilities to implement monofilament yarn into the knitting elements with controlled measurement of amount to minimize tension and improve knitting of monofilament yarn such that it does not poke thru the face and back of finished product.

Further information relating to the sample testing follows:

Laminated One Side—BK 3595 Heavy—22 oz/sq.yd, BK 3571 Light—19 oz/sq yd.

Unlaminated BK 3595 Heavy—21 oz/sq yd, BK 3571 Light—16.7 oz/sq yd.

Beverly Knits specs the Unlaminates at 22.9 and 18 oz respectively, so we start from different baselines. Nevertheless, the added weight of Shawmut one-sided laminate is approximately 1–2 ounces.

The equivalent neoprene is 32–42 ounces per square yard.

Laminated One Side—Gehring (802 F), Shawmut 1 and 3—15 oz/sq. yd.

Unlaminated Gehring 802 F—13 oz/sq. yd

Gehring does not specify the weight of their fabric. The added weight of Shawmut one-sided laminate is approximately 2 ounces per square yard.

The equivalent neoprene is 21–26 oz/sq.yd.

Summary: These are Very Desirable numbers for BK because of the low spacer weight and the low laminate weight. These are Desirable numbers for Gerhing because of the moderate spacer weight and low laminate weight.

Elasticity/Modulus

As a matter of comparison to baseline unlaminates:

Laminated One Side BK 3595 Heavy—elasticity and modulus are in the 30% and 150% range, respectively, of original unlaminated measurements. The original numbers were Desirable to Very Desirable for elasticity and Desirable for modulus. The lamination has changed those values to Acceptable.

Laminated One Side BK 3571 Light—elasticity and modulus are in the 50% and 200% range, respectively, of original unlaminated measurements. The original numbers were Desirable for elasticity and Very Desirable for modulus. The lamination has changed those values to Unacceptable.

Laminated One Side Gehring (802 F), Shawmut 1 & 3—elasticity and modulus are in the 70% and 135% range, respectively of original unlaminated measurements. The original numbers were Desirable for elasticity and Very Desirable for Modulus. The lamination has changed rounded those values to the mid-to low end of Desirable.

Summary: BK Elasticity and Modulus values suffered more than the Gehring samples. If these values for elasticity and modulus are not compromised further by the addition of an inside film, the BK 3595 Heavy and the Gehring 1 & 3 remain viable for prototype.

Abrasion

Abrasion tests are compared to premium and standard nylon coated neoprene. The number indicates how many passes were made on a rough surface before the nylon abraded. The higher the number, the better the abrasion resistance.

Premium Heavy Nylon Neoprene—87.

Standard Nylon Neoprene—38.

Laminated One Side BK 3595 Heavy—44.

Laminated One Side BK 3571 Light—51.

Laminated One Side Gehring 802 (Shawmut 1 & 3)—43.

Summary: These values are acceptable for most contact areas. Heavy contact areas (knees, elbows, seat,) will require additional abrasion resistance through pads or other coatings.

Bonding

Lamination integrity under 8 hour high duress conditions (to simulate 1–2 years of normal stress) was Very Desirable.

Permeability

Water impermeability before and after bonding tests was Very Desirable. Surprisingly, the introduction of 10% SPANDEX yarn in the yarn component system(s) required much experimentation with the machine set-up, wherein a setting of 17% was required for the material to be produced and reproduced consistently, providing the following material properties:

By increasing the spandex percentages and reducing the yarn sizes, the results created a fabric with the third yarn system in an almost vertical plane. This is most important to achieve the compression resistances of the require applications. This surprise allowed the reduction of monofilament used in the fabric to be decreased by almost 50%. The results thus produced fabrics of preferred weight variations, stretches and thickness.

BK 3595 Light; 17% spandex; 18.00 ounces per square yard weight; 100% length×150% width stretch, 6 mm thick.

BK 3595 Heavy; 17% spandex 22 ounces per square yard weight; 120% width×200% length stretch, 6 mm thick.

BK 3571 Light; 10% spandex; 18.00 ounces per square yard weight; 80% length×90% width stretch, 5 mm thick.

Bk 3571 heavy; 10% spandex 28 ounces per square yard weight; 90% width×160% length stretch, 6 mm thick

What is claimed is:

1. A knitted spacer material comprising a fabric for stretch and compression-resistance applications in garments having a face surface and a back surface in spaced apart relation with a body portion constructed therebetween, the surfaces providing a substantially uniform surface for distributing compressive forces uniformly thereover wherein the fabric further includes a stretch yarn component for increased stretch and compression resistance of the material.

2. The knitted spacer material according to claim 1, wherein the material is a circular knit spacer material.

3. The knitted spacer material according to claim 1, further including at least two yarn systems, including a first yarn system and a second yarn system, wherein at least one of the yarn systems includes a monofilament component.

4. The knitted spacer material according to claim 1, further including at least three yarn systems, wherein at least one of the yarn systems includes a monofilament component.

5. The knitted spacer material according to claim 1, wherein the material is a carrier material.

6. The knitted spacer material according to claim 5, wherein the carrier material further includes a coating.

7. The knitted spacer material according to claim 5, wherein the carrier material is laminated.

8. The knitted spacer material according to claim 5, wherein the carrier material is infused with a supplemental component.

9. The knitted spacer material according to claim 8, wherein the supplemental component is a medication.

10. A knitted spacer material comprising at least two yarn systems interconnected via a knitting pattern wherein at least one of the at least two yarn systems includes a stretch yarn component and at least one of the at least two yarn systems includes a monofilament component, wherein the stretch yarn component provides for substantially uniform stretch and compression resistance and permits the monofilament to be present in up to about 50% reduced quantity compared to a fabric manufactured by the same knitting pattern without the inclusion of a stretch yarn component.

11. The material according to claim 10, wherein the material is a circular knitted material.

12. The material according to claim 10, wherein the material is a weftknitted material.

13. A method of manufacturing a knitted spacer material comprising the steps of:

providing at least two yarn systems for interconnecting via a knitting pattern, wherein at least one of the at least two yarn systems includes a stretch yarn component and at least one of the at least two yarn systems includes a monofilament component;

knitting the stretch yarn component according to the pattern, which permits the elimination of up to about 50% of the monofilament weight of a standard, non-stretch spacer fabric without a stretch yarn component, while providing for comparable stretch and compression resistance, decreased weight, and increased conformability of the spacer material compared to the standard, non-stretch spacer fabric, and wherein any further processing of the fabric does not eliminate dimensional stretch of the material.

14. The material according to claim 1, wherein the material is used in intimate apparel applications.

15. The material according to claim 1, wherein the material is used in diving and wet suit applications.

16. The material according to claim 1, wherein the material is used in garment applications.

17. The material according to claim 13, further including the step of treating the material with a surface treatment for use in diving and wet suit applications.

18. The material according to claim 13, further including the step of controlling and minimizing tension during the knitting process to prevent poke through of the monofilament component to the face and back surfaces of the fabric.

* * * * *